US007370710B2

(12) United States Patent
Trueman et al.

(10) Patent No.: US 7,370,710 B2
(45) Date of Patent: May 13, 2008

(54) ERECTABLE ARM ASSEMBLY FOR USE IN BOREHOLES

(75) Inventors: Robert Trueman, Brisbane (AU); Timothy Gregory Hamilton Meyer, Brisbane (AU); Matthew Stockwell, Brisbane (AU)

(73) Assignees: University of Queensland, Queensland (AU); Commonwealth Scientific and Industrial Research Organization, ACT (AU); BHP Coal Pty. Ltd., Queensland (AU)

( * ) Notice: Subject to any disclaimer, the term of this patent is extended or adjusted under 35 U.S.C. 154(b) by 38 days.

(21) Appl. No.: 10/957,104

(22) Filed: Oct. 1, 2004

(65) Prior Publication Data

US 2005/0067166 A1 Mar. 31, 2005

Related U.S. Application Data

(63) Continuation of application No. 09/917,612, filed on Jul. 27, 2001, now abandoned, which is a continuation of application No. 09/445,161, filed on Dec. 6, 1999, now abandoned.

(51) Int. Cl.
*E21B 7/08* (2006.01)

(52) U.S. Cl. ..... 175/62; 175/77; 175/78

(58) Field of Classification Search ..... 175/62, 175/77, 78–82; 299/17
See application file for complete search history.

(56) References Cited

U.S. PATENT DOCUMENTS

| | | | |
|---|---|---|---|
| 1,435,144 | A | 11/1922 | Bignell |
| 1,660,999 | A | 2/1928 | Macdonell |
| 1,865,853 | A | 7/1932 | Granville |
| 2,282,431 | A | 5/1942 | Smith et al. |
| 2,516,421 | A | 7/1950 | Robertson |
| 3,191,697 | A | 6/1965 | Haines |
| 3,488,765 | A | 1/1970 | Anderson |
| 3,844,362 | A | 10/1974 | Elbert et al. |
| 3,858,398 | A | 1/1975 | Van Weele |
| 3,873,156 | A | 3/1975 | Jacoby |

(Continued)

FOREIGN PATENT DOCUMENTS

DE 3012482 A1 10/1981

(Continued)

OTHER PUBLICATIONS

Maramzin, A.V., "Automation and Mechanization of Tripping Process (Review of foreign patents)", pp. 83-84.

(Continued)

*Primary Examiner*—Hoang Dang
(74) *Attorney, Agent, or Firm*—Perkins Coie LLP

(57) ABSTRACT

An erectable arm assembly for use in a borehole, the erectable arm assembly comprising a main body and an arm member, the arm member being able to move between a collapsed position in which the assembly can be removed from the borehole and an erected position, the erectable arm assembly being adapted to house a fluid drilling assembly comprising a fluid cutting device and a flexible hose drill string such that the arm member during erection can contain at least part of the fluid drilling assembly, and when in the erected position the arm member is able to guide the fluid cutting device towards the borehole wall, the assembly further including at least one sensor for monitoring the arm member or the fluid drilling assembly.

17 Claims, 8 Drawing Sheets

U.S. PATENT DOCUMENTS

| | | | |
|---|---|---|---|
| 3,874,733 | A | 4/1975 | Roundstone et al. |
| 3,881,775 | A | 5/1975 | McPherson et al. |
| 3,887,021 | A | 6/1975 | Elbert |
| 3,917,007 | A | 11/1975 | Tsiferov |
| 4,007,797 | A | 2/1977 | Jeter |
| 4,273,193 | A | 6/1981 | Tompkins |
| 4,437,706 | A | 3/1984 | Johnson |
| 4,440,242 | A | 4/1984 | Schmidt et al. |
| 4,458,766 | A | 7/1984 | Siegel |
| 4,497,381 | A | 2/1985 | Dickinson |
| 4,503,918 | A | 3/1985 | Bergkvist et al. |
| 4,527,639 | A | 7/1985 | Dickison |
| 4,637,479 | A | 1/1987 | Leising |
| 4,640,362 | A | 2/1987 | Schellstede |
| 4,674,579 | A | 6/1987 | Geller |
| 4,714,118 | A | 12/1987 | Baker |
| 4,754,526 | A | 7/1988 | Tremoulet, Jr. et al. |
| 4,765,416 | A | 8/1988 | Bjerking |
| 4,773,113 | A | 9/1988 | Russell |
| 4,826,087 | A | 5/1989 | Chinery |
| 4,850,440 | A | 7/1989 | Smet |
| 4,930,586 | A | 6/1990 | Turin |
| 4,991,667 | A | 2/1991 | Wilkes |
| 5,179,753 | A | 1/1993 | Flaherty |
| 5,197,783 | A | 3/1993 | Theimer |
| 5,255,750 | A | 10/1993 | Wilkes |
| 5,288,173 | A | 2/1994 | Jenne |
| 5,314,030 | A | 5/1994 | Peterson et al. |
| 5,322,134 | A | 6/1994 | Dahn |
| 5,413,184 | A | 5/1995 | Landers |
| 5,439,066 | A | 8/1995 | Gipson |
| 5,492,184 | A | 2/1996 | Jenne |
| 5,513,713 | A | 5/1996 | Groves |
| 5,814,162 | A | 9/1998 | Barrett |
| 5,853,056 | A | 12/1998 | Landers |
| 5,899,283 | A | 5/1999 | Cox |
| 5,950,743 | A | 9/1999 | Cox |
| 5,992,547 | A | 11/1999 | Caraway et al. |
| 6,012,536 | A | 1/2000 | Puttmann |
| 6,089,336 | A | 7/2000 | Nexton et al. |
| 6,109,370 | A | 8/2000 | Gray |
| 6,231,270 | B1 | 5/2001 | Cacossa |
| 6,263,984 | B1 | 7/2001 | Buckman |
| 6,470,978 | B2 | 10/2002 | Trueman |
| 6,530,439 | B2 | 3/2003 | Mazorow |
| 6,866,106 | B2 | 3/2005 | Trueman et al. |
| 7,083,011 | B2 | 8/2006 | Meyer |
| 2003/0164253 | A1 | 9/2003 | Trueman |

FOREIGN PATENT DOCUMENTS

| | | |
|---|---|---|
| FR | 2493907 | 5/1982 |
| GB | 2289298 A | 11/1995 |
| JP | 06346676 A | 12/1994 |
| RU | 1093062 | 8/1994 |
| WO | WO-95/09963 | 4/1995 |
| WO | WO-97/21900 | 6/1997 |
| WO | WO-03/042491 | 5/2003 |

OTHER PUBLICATIONS

International Search Report for International Application No. PCT/AU 98/00422; mailed Jul. 21, 1998; Applicant: The University of Queensland et al.; 4 pgs.

Derwent Abstract Accession No. K7867B/46, SU 649815, A (UKR Col Hydr Minin) Feb. 28, 1979.

ERECTABLE ARM ASSEMBLY FOR USE IN BOREHOLES

CROSS-REFERENCE TO RELATED APPLICATIONS

This application is a continuation of U.S. patent application Ser. No. 09/917,612, filed Jul. 27, 2001 now abandoned, which is a continuation of U.S. patent application Ser. No. 09/445,161, filed Dec. 6,1999, which is now abandoned.

FIELD OF THE INVENTION

This invention relates to an erectable arm assembly for use in boreholes, and particularly relates to an assembly which can direct a fluid cutter into the borehole wall.

BACKGROUND ART

Whipstocks are well known in the mining and petroleum industries and are used to change the direction of a drill hole (directional drilling). Since the earliest times, boreholes were made to deviate by placing tapered wedges or "whipstocks" in the borehole to force the bit sideways into a new direction, and it is well known that different bottom-hole assemblies had a tendency either to increase or decrease the inclination of the hole. No one drilling method is satisfactory for all radii of curvature. It is therefore customary to distinguish among these as long-, medium-, short-, and ultra-short-radius methods. The invention relates to ultra-short-radius methods which are typically defined to have a radius of 2 ft. (0.6 m) or less.

Directionally drilled wells fall into two main categories. In the first category, the task is to reach locations that are not accessible through straight, vertical holes. The objective is to reach a substantial distance horizontally away from the drilling location. The second category consists of wells in which part of the well that lies in a particular oil or gas reservoir is given a particular orientation so as to increase productivity. An example of this second category is a vertically thin reservoir where a horizontal hole can contact a greater part of the reservoir than a vertical one, increasing the drainage contact area. It is this second category to which the invention primarily relates.

Ultra-short-radius whipstocks have been developed that are applicable to the second category of directional drilling.

A common feature of existing ultra-short-radius whipstocks is a requirement to incorporate a device in the bottom-hole assembly that either pushes the drill string around the ultra-short-radius and into the deposit which is to be drilled, or uses a complicated hydraulic piston drive arrangement. Drill strings for use with these whipstocks are either segmented or coiled tubing.

More elaborate devices are also known to turn a drill string and/or cutter into the borehole wall. For instance, U.S. Pat. No. 5,197,783 describes a cavity forming device for use in boreholes and which has an erectable arm member provided with a fluid cutting jet to cut a large cavity in the borehole.

U.S. Pat. No. 4,497,381 describes a drill string bending assembly which has an extending arm portion to direct the drill string into the sidewall.

A disadvantage with existing whipstocks and other similar assemblies is in correctly determining various parameters in the down hole and drilling process. For instance it is necessary to determine the distance travelled by the fluid cutter, whether the segmented or coiled tubing drill string is feeding properly through the bore, when the fluid cutter is properly retracted so that the arm member can be retracted, the orientation of the arm member, the degree of inclination of the arm member, and so on.

The assembly of the invention can be used with a drilling system that uses a high pressure hose as a flexible hose drill string and a self-advancing fluid jet cutting nozzle. Such a nozzle has been described in International Application No. PCT/AU96/00783.

OBJECT OF THE INVENTION

The present invention is directed to a method for directional drilling of lateral boreholes from an existing borehole, and to an assembly which can be lowered down the existing borehole and where the assembly has an arm member which can be erected to position a cutter and/or drill string into a side wall of the borehole.

Optionally, the assembly can cut a slot into the side wall of the borehole as the arm is erected.

It is an object of the invention to provide a method and assembly which may overcome the abovementioned disadvantages or provide the consumer with a useful or commercial choice.

In one form of the invention, there resides, an erectable arm assembly for use in a borehole, the erectable arm assembly comprising a main body and an arm member, the arm member movable between a collapsed position in which the assembly can be removed from the borehole and an erected position, the arm assembly being adapted to house a fluid drilling assembly comprising a fluid cutting device and a flexible hose drill string such that during erection the arm member can contain at least part of the fluid drilling assembly, and when in the erected position the arm member is able to guide the fluid cutting device towards the borehole wall, the assembly further including at least one sensor for monitoring the arm member or the fluid drilling assembly.

In a second form, the invention resides in a method for forming at least one lateral borehole from an existing borehole, the method comprising lowering an erectable arm assembly into the borehole to a desired position, the assembly having a main body and an erectable arm member, positioning a self-advanceable fluid cutting device to be supported by the arm member at least as the arm member is erected, operating the fluid cutting device to self advance the fluid cutting device from the arm member and into the side wall of the borehole to form a lateral bore in a direction dictated by the position of the arm member in the borehole.

In a third form, the invention resides in an erectable arm assembly for use in a borehole, the assembly comprising a main body and an arm member which can move between a collapsed position where the assembly can be installed and removed from the borehole, and an erected position where the arm member can guide a fluid drilling assembly towards the borehole wall.

In another form, the invention resides in a method for forming at least one lateral borehole of known distance from an existing borehole, comprising lowering an assembly in the borehole to a desired position, the assembly having a main body and an erectable arm member, positioning a self-advanceable fluid cutting device to be supported by the arm member at least as the arm member is erected, operating the fluid cutting device to self-advance the fluid cutting device from the arm and into the side wall of the borehole to form a lateral bore in a direction dictated by the position of the arm member in the borehole.

It is preferred that the method comprises monitoring the length of the lateral bore by at least one sensor on the assembly.

The method can be used to form several lateral bores approximately in the same plane but in different directions, and this can be achieved by turning the assembly in the existing borehole before launching the fluid cutter. The method may also be used to form several lateral bores in different planes.

The method can include an assembly as described above and having various sensors as described above.

The method and assembly can be used as a tight radius drilling system (TRD) by which is meant that the flexible hose drill string can be turned through 90 degrees within a short radius, typically less than 300 mm.

The method and assembly can be used to drill multiple lateral boreholes from a single existing borehole in the same horizon and/or at multiple horizons, for instance to extract methane from coal seams. The existing boreholes are typically vertical or near vertical. The lateral boreholes generally follow the direction of a coal seam and are typically horizontal. After completion of the lateral boreholes, production of gas from the well is started by lowering the water level in the existing borehole with a simple foot pump or the like. This technique is extremely effective in coal seams where the methane desorption pressure is equal to or less than the hydrostatic head of the ground water table, as is the case for the majority of the coal deposits in the world.

The current method and assembly can form horizontal lateral boreholes in excess of 200 metres almost directly from the existing borehole well. In this manner it is possible to drain a relatively large area of coal from a single borehole. The borehole may extend to a depth of at least 400 metres and in some cases may exceed 600 metres.

The tight radius bend helps eliminate a lot of the problems encountered with dewatering larger radius deviated wells by requiring only a basic foot pump inserted into the existing borehole to drain all of the lateral boreholes branching from that well.

The method and assembly described above are adapted particularly but by no means exclusively for use in recovering methane from underground deposits such as coal seams. Alternatively, one form of the invention is a method and assembly for recovering methane from underground deposits which incorporate the above described method for directional drilling and the assembly.

Suitably, the main body of the assembly is elongate and has a prismatic configuration or tubular configuration. The main body may have a channel like cross section.

The arm member may be pivotally attached to the main body such that it can move about a pivot axis between its retracted position and its extended position. It is preferred that the arm member, in the retracted position, sits entirely within or substantially entirely within the main body. For instance, the main body may have an open front through which the arm member can extend. Alternatively, the main body may be provided with a recessed portion in which the arm member lies when the arm member is in the retracted position.

The arm member may comprise a single member, or a number of members coupled together. For instance, if the flexible hose drill string, when guided through the assembly, requires a larger degree of curvature, the arm member may be formed from two linked members.

The arm member may comprise a single member, or a number of separate members which can be hinged together, telescoped together, and the like.

When the arm member is in the retracted position, it should not form any hindrance to movement of the assembly in the borehole.

The arm member may be moved between its retracted and extended position by an actuator. The actuator may be located within the main body. The actuator may comprise a hydraulic or pneumatic ram, one end of which is attached relative to the main body, and the other end of which is attached relative to the arm member.

The arm member may comprise a sliding link arrangement. In this arrangement the arm member may be hingedly coupled relative to the body. A link member may be pivotally coupled to the arm member and to –a slide. The slide can move along a track and is coupled to an actuator. The actuator can cause the slide to move along its track which in turn can cause the arm member to move between its retracted and extended positions.

It is preferred that the arm member is configured to allow it to support a flexible hose drill string. Thus, when the assembly is placed in position, and the arm member is moved to its extended position, the arm member can be maintained in its extended position and a flexible hose drill string can be passed down the existing borehole through an upper portion of the tubular body and along the arm member thereby positioning the drill string for lateral borehole formation.

To achieve this, the arm member may be tubular in configuration to allow the flexible hose drill string to pass therethrough. Alternatively, other methods of supporting the flexible hose drill string are envisaged such as struts, guides, and the like.

In another form of the invention, the assembly houses a self-advancing fluid cutting device. The fluid powered cutting device may be self-propelled and may be steerable.

The cutting device may be connected to a flexible hose drill string in the form of a tube or hose or combination thereof, through which high pressure fluid can pass to provide the required propulsion of the cutting device, and optionally also to provide high pressure fluid to the forward nozzles.

In this form of the invention, the cutting device may be held by the arm member, and if the arm member is tubular, may be positioned within the arm member.

Guide members in the form of rollers, pulleys, and the like, can be positioned within the tubular body and/or on the arm member to guide the tube or hose through the assembly as the cutting device moves away from the assembly. The cutting device, in an embodiment, has a substantially tubular steel body with at least one forwardly directing high pressure water jet cutting nozzle, and at least one rearwardly facing thrusting jet to propel the device in a forward direction.

The assembly can be positioned at a desired elevation in the existing borehole and used to launch the cutting device to cut a series of lateral boreholes. The assembly can be turned in the borehole before the cutting device is again launched. A clamping means can be provided to clamp the assembly in the borehole at the desired azimuth. The clamping means may be provided on the assembly below the arm member and may comprise an extendible member which can be actuated to clamp the assembly against the borehole wall or casing.

To facilitate smooth movement of the arm member, at least one flushing jet may be provided to flush away any cuttings which may settle on the assembly and especially around the arm member as the cutting device is operative.

If the assembly has no self slotting capability, a cavity is required in the existing borehole to allow the arm member to be erected. Conventional cavity formers are well known, but these devices are not generally able to form cavities of a precise size and shape. If the assembly is lowered into a cavity which is too large, and the arm member erected, the free end of the arm member may be some distance from the cavity wall. If the fluid cutting device is launched, it can become jammed between the end of the arm member and the cavity wall, or can lose its desired orientation.

Therefore a cavity reamer can be provided which can cut cavities of sufficient accuracy to allow proper working of the assembly. The cavity reamer may comprise a rotatable main body which can be lowered down an existing borehole and a plurality of erectable arm members which can be moved between a collapsed position substantially in line with the main body, and an extending position where the arm members contact the side wall of the borehole, the arm members being provided with cutting means to cut a cavity in the borehole as the reamer is rotated in the borehole, and means to urge the arm members into the extended position.

In another variation to the invention, the arm member can have cutting means to cut a slot into the wall of the borehole as the arm member moves towards its extended position. In this embodiment, the assembly can cut a slot as the arm member extends from the main body and therefore the need for a cavity may be eliminated or an undersized cavity may be used.

The cutting means may comprise any type of cutting means which can cut into the side wall of the borehole as the arm member is extended. Suitably, the cutting means comprises high pressure fluid which may pass through one or more nozzles.

It is preferred that a number of cutting means are provided and these nay be spaced along the arm member. Suitably, the one or more cutting means are located on a leading edge of the arm member, that is, the edge or portion of the arm member that is proximal to the side wall of the borehole which is to be cut.

If the cutting means comprises high pressure fluid passing though nozzles, it is preferred that the nozzles are spaced along the arm member such that the spacing between a first nozzle and a second nozzle is about that of the working distance of the high pressure fluid. That is, if the high pressure fluid is able to efficiently cut a certain distance, the second nozzle is preferably positioned at that distance such that high pressure fluid passing through the second nozzle extends the cutting distance of the combined working fluids.

A number of sensors and/or instrumentation components can be included in order to control the drilling system. Excess feed of high pressure hose from the surface can cause bunching at the assembly entry. A hinge joint on one of the rollers may have a strain gauge to measure force on the roller. This gives an indication of tension on the high pressure hose through the assembly. A position transducer in the hydraulic ram and a tilt transducer in the arm member can measure the arm member inclination. A contact or inductive sensor can be located in the arm member to indicate the positive retraction of the drilling assembly from the lateral borehole. Pressure transducers and temperature gauges may be located in the assembly to measure existing borehole hydrostatic pressure and temperature. An optical sensor may be located in the assembly to pick up reflected light from cuttings as they exit the lateral boreholes enabling colour change to be assessed. An assessment of the strata in which drilling is carried out can therefore be made.

More particularly, location of the cutting device in the arm member can be detected by an electro-magnetic sensor which detects the presence of the steel body of the cutting device. The sensor can be positioned in the arm member. In addition to, or as an alternative to the above electromagnetic sensor, an electric sensor can be provided which detects the steel body of the cutting device by using the steel body to complete an electric circuit.

Correctly determining that the cutting device is fully within the arm member is important to prevent jamming of the arm member upon its retraction.

The erection angle of the arm member is important to determine the launch angle of the cutting device within the arm member. A sensor to determine the extension of the ram can be used which will determine the erection angle of the arm member relative to the main body of the assembly. In addition thereto, or alternatively thereto, an arm member inclination sensor can be used. This sensor can comprise a tilt transducer.

In addition to the degree of extension of the arm member from the body portion, it is important to determine the azimuth of the assembly to correctly position the arm member to enable lateral boreholes to be cut around the existing borehole. In one embodiment a compass can be used to determine the azimuth.

With the use of flexible hose as the drill string, there is a tendency for the hose to coil or buckle in the borehole. Therefore, the length of hose lowered into the existing borehole is not always a good indication of the length of the lateral borehole cut by the fluid cutter. The assembly may therefore include a sensor to detect the speed and the direction of hose travel through the assembly. The sensor may comprise an encoder wheel in the assembly which is biased against the hose.

Other sensors may be provided which are not part of the assembly but which determine various parameters of the flexible hose drill string. For instance, a surface sensor may be provided to determine the amount of tension in the hose feeding down the existing borehole, and this sensor can comprise a load cell. The hose may be wound around a hose drum which may include a load cell to determine the tension in the hose.

BRIEF DESCRIPTION OF THE DRAWINGS

Embodiments of the invention will be described with reference to the following drawings in which

FIGS. 3, 3A and 3B are views of the assembly of FIG. 2 with the arm in an extended position.

BEST MODE

Figure 1:
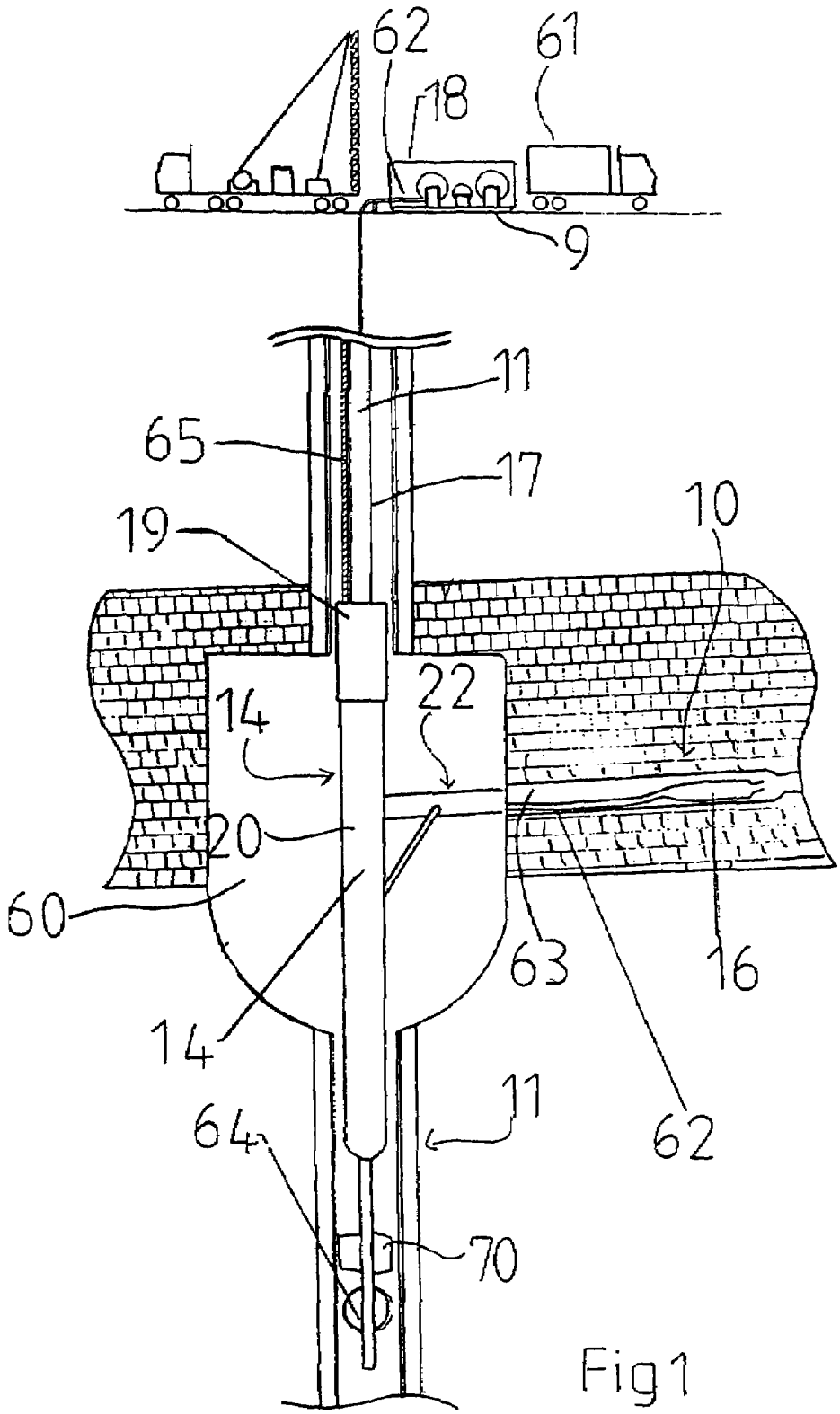
FIG. 1 is a diagrammatic view showing a vertical borehole and a coal seam.

Referring to the figures, and initially to FIG. 1, there is shown diagrammatically an ultra-short-radius drilling method and assembly for cutting a substantially horizontal bore 63 into a coal seam 10 from an existing vertical borehole 11.

FIG. 1 shows a vertical bore 11 pre-drilled into the ground and extending through a coal seam 10.

An assembly 14 is shown in FIG. 1 and which is positioned in a pre-formed slot or cavity 60 in one side of vertical borehole 11.

A self-advancing steerable fluid cutting device 16 has been positioned substantially horizontally into coal seam 10 by virtue of the assembly 14.

The self-advancing cutting device 16 has a tubular steel body about 40-80 cm long and 5-15 cm in diameter. The body has a number of rearwardly facing high pressure retro jet thrusters which propel the cutting apparatus in a forward direction. The front face of the cutting device is provided with one or more high pressure water jet cutters to cut the bore. High pressure water is supplied to the cutting device by a surface pump 61 and through a high pressure flexible hose 62 which is attached to the rear of cutting device 16. Hose 62 is flexible and can pass through the assembly 14 as the cutting device moves along the bore 63. To retract the cutting device 16 it is dragged back along bore 63 by winding the flexible hose 62 onto hose winch 18, and until the cutting device is back in the arm member 22.

The flexible hose drill string 62 which extends to the surface and to a high pressure pump 61 and hose winch 18. High pressure fluid is passed through hose 62 to power the forward water jet cutters of the device 16 and also the retro-thrusters which propels the device forwardly and against the coal face to be cut by the water jets.

The cutting device 16, in the retracted "at home" position, is initially within erectable arm member 22 which can move from a collapsed position where it is inside main body 20 of assembly 14 to an erect position as illustrated in FIG. 1. Of course, the arm member can adopt a partially erect position, with the position of the arm member determining the point of entry of the fluid cutting device 16 into the cavity side wall.

Cutting device 16 can be lowered down the vertical borehole and fed into arm member 22 when the arm member is in the collapsed position, or can be prepositioned in arm member before the assembly is lowered into the vertical bore. In both instances, the cutting device 16 is in the arm member as it is raised.

As the cutting device propels itself from the arm member 22 by virtue of the retro thrusters on the cutting device, various sensors (better described with reference to FIG. 7) detect that the cutting device has been released from the arm member 22 and track the distance of travel of the cutting device. The sensors also ensure that the cutting device is fully retracted into arm member 22 before the assembly is collapsed for withdrawal from the borehole, or for repositioning in the cavity to allow a further lateral bore to be cut by the cutting device.

Assembly 14 is releasably locked into position by a clamping means in the form of a borehole clamp 70. Clamp 70 is positioned on a the centralising tail piece 64 of assembly 14 and below the cavity 60. The clamp 70 consists of an hydraulically operated ram, a number of link members, and an expanding mechanism which pushes against the borehole casing thereby securing the assembly against twisting in the vertical borehole. Hydraulic power can comprise pressurised water.

Borehole clamp 70 prevents assembly 14 from undesired twisting in the vertical bore as the cutting device is in operation. As the cutting device leaves arm member 22, the high pressure retro jets thrust against the sides of the arm member. Should the assembly twist, the arm member will twist away from the borehole entrance formed by the cutting device, and this can cause a sharp bend to form in the high pressure hose which can prevent advancement of the cutting device.

An instrument housing 19 is provided above arm member 22 to process the data from the various sensors.

Cavity 60 should be formed with good control of the cavity diameter to ensure that the end of arm member 22, when erect, is against, or spaced sufficiently close to the cavity wall, to ensure that the cutting device 16 in arm member 22 is launched correctly. For instance, the free gap between the end of arm member 22 and the cavity side wall should be less that half the length of the cutting device.

The assembly of FIG. 1 is supported by a tubular steel drill rods 17 which consists of rigid steel rods coupled together as is known in the art. Alternatively, the assembly can be lowered down by coiled tubing as is also known in the art. A control umbilical bundle 65 which incorporates cables and hoses for electric, hydraulic and water control, is strapped to tubular steel drill rods 17 and sends sensor information from the sensors and instruments within instrument housing 19 to the surface computer(s).

The assembly therefore allows accurate tracking of the position of the fluid cutter relative to the assembly.

A surface skid 9 can be provided to contain the necessary equipment to lower and raise the assembly and to control the cutting device 16, and the skid can contain the computers to decode the sensor readings.

FIG. 1 is merely illustrative of the general parts and features of the invention.

Figure 7:
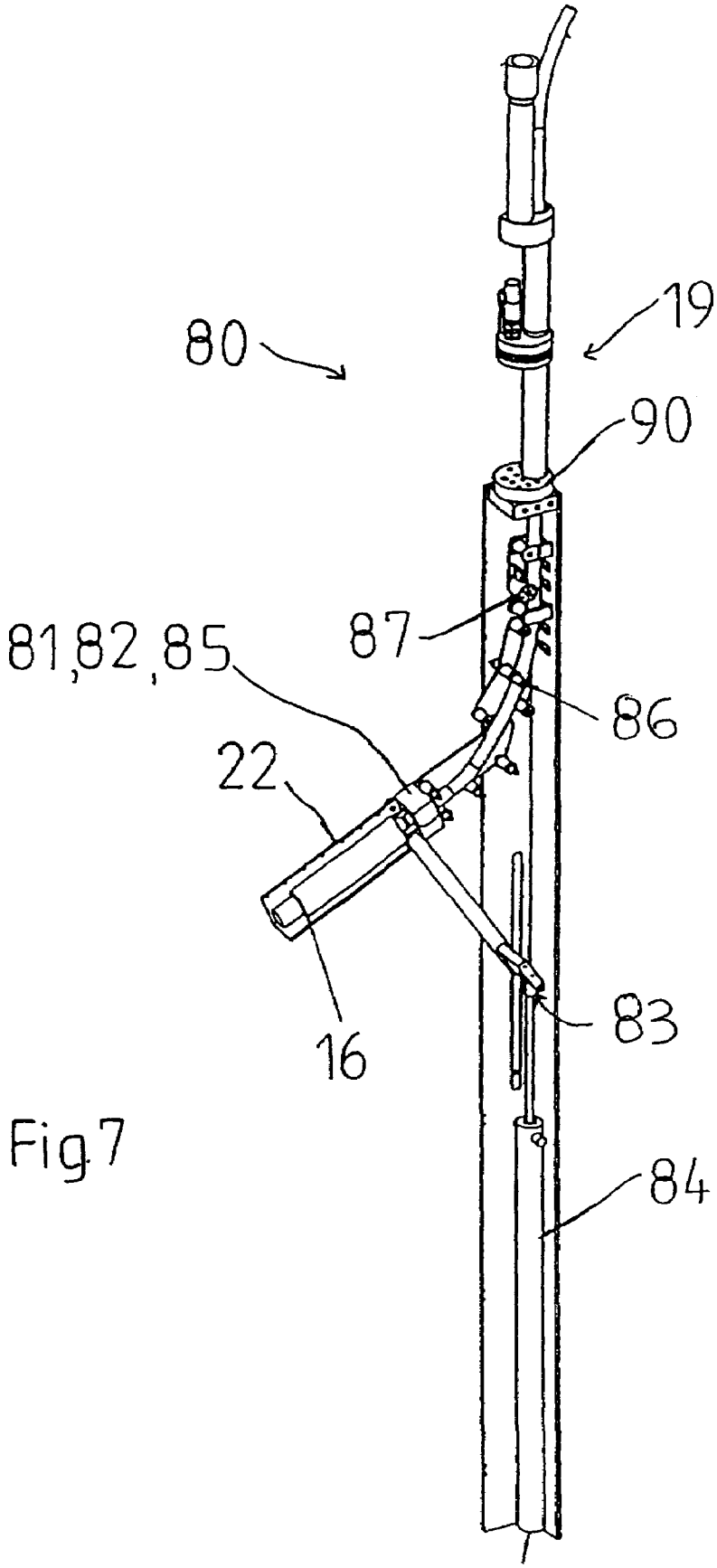
FIG. 7 is a view of an assembly according to a further embodiment of the invention and which contains a number of sensors.
Figure 8:
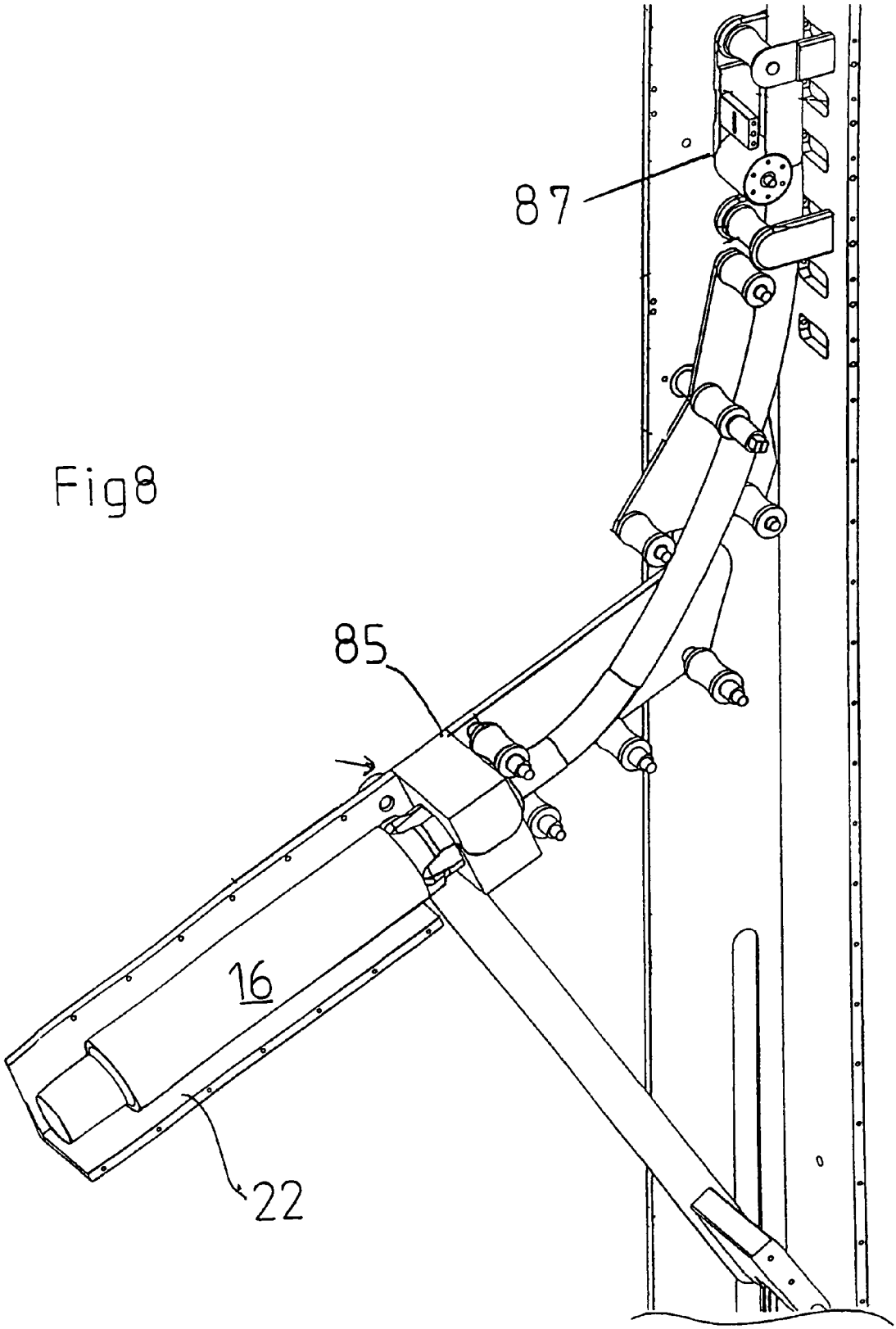
FIG. 8 is a close up view of the arm member of FIG. 7.

FIGS. 7 and 8 illustrate an assembly 80 provided with various sensors and instrument packages. Like numbers have been used to identify like parts. Assembly 80 has an arm member 22 in which a cutting device 16 is located when the cutting device is in the retracted position. In this embodiment, arm member 22 is substantially enclosed to define a cage. Inside the arm member is an electro magnetic sensor 81 which detects the presence of the steel bodied cutting device 16 using an alternating magnetic field. Sensor 81 is used to detect when the cutting device 16 is fully retracted into the arm of the assembly. It should be realised that failure to fully retract cutting device 16 before collapsing assembly 80 can result to jamming the assembly in the vertical borehole. Sensor 81 is positioned such that it detects the steel body of cutting device 16 only when the cutting device is fully retracted into arm member 22.

As a backup, a second electric sensor 82 is provided. This sensor is also positioned on arm member 22 and detects full retraction of cutting device 16 into the arm member by using the steel body of the cutting device to complete an electric circuit which in turn causes the resistivity of the circuit to drop significantly when the cutting device makes contact with the sensor.

Assembly 80 has an hydraulic ram 84 which extends and collapses arm member 22. A ram position sensor 83 comprising a linear transducer is incorporated into the ram rod. The signal from the transducer relates directly to the extension of the ram which can be related back to the angle of elevation of arm member 22.

As a backup to the ram position sensor 83, an arm inclination sensor 85 is provided on arm member 22. Sensor 85 is a tilt transducer whereby electrical resistance can be related directly to the relative orientation of the transducer around its central axis. Sensor 85 in combination with ram position sensor 83 allows for a redundancy in determining the arm inclination, and in the event of mechanical failure of arm member 22, the sensors in combination will provide some diagnostic information.

Assembly 80 further includes a compass 86. Compass 86 is a flux-gate magnetic compass which is used to indicate the azimuth of the front of assembly 80. Sensor 86 is electronic and is mounted at the toe of the assembly away from magnetic material. Sensor 86 is necessary for correctly positioning the radial lateral boreholes around the central existing borehole. Sensor 86 will work in combination with fibreglass casing, as steel casing will cause false readings. A gyroscopic compass will be used in applications with steel casing.

Assembly 80 further includes a flexible hose travel sensor 87. Sensor 87 includes an encoder wheel which is used to detect the speed and direction of hose travel through assembly 80. In the embodiment, sensor 87 is a roller wheel which is spring loaded against the flexible hose. As the hose moves through the assembly, the roller wheel rotates. A series of magnets are placed circumferentially around both sides of the roller. Additional sensors are situated such that the magnets pass these sensors as the roller turns. A signal from the additional sensors can be interpreted for speed and direction of travel of the hose. The hose travel sensor 87 gives a good indication of whether the cutting device 16 is penetrating into the coal seam and helps prevent feeding too much hose from the surface hose winch 18. (Too high a feed rate can cause bunching of the hose and risk hose damage and jamming of the assembly in the existing borehole).

Instrument housing 19 includes circuit boards, provides a power supply to the various sensors, receives signals from the sensors and sends data to the surface. Instruments housing 19 contains a temperature transducer 88 to monitor the temperature inside instrument housing 19. A pressure gauge 90 is provided to measure hydrostatic pressure.

On the surface, other sensors can be used to determine the amount of tension in the hose feeding down the existing borehole. For instance, load cells may be positioned on winch drums and supporting structures to record loads indicative of hose tension, to ensure that the hose is not overtensioned. An additional related sensor can be provided on the hose winch drum and can consist of a load cell which indicates the torque provided by the hose drum motor. This data helps determine the tension in the hose at the surface and it compliments the load cell situated in the foot of the goose neck.

A surface computer can be used to interpret the signals coming from the instrumentation on the assembly and at various places around the surface skid.

Figure 2A:
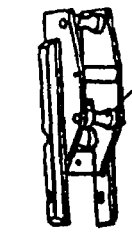
FIGS. 2, 2A and 2B are views of an assembly according to an embodiment of the invention with the arm member in a retracted position.
Figure 2B:
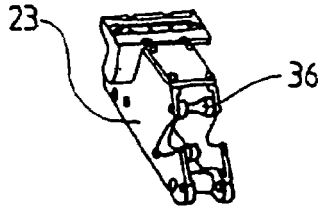
Figure 2:
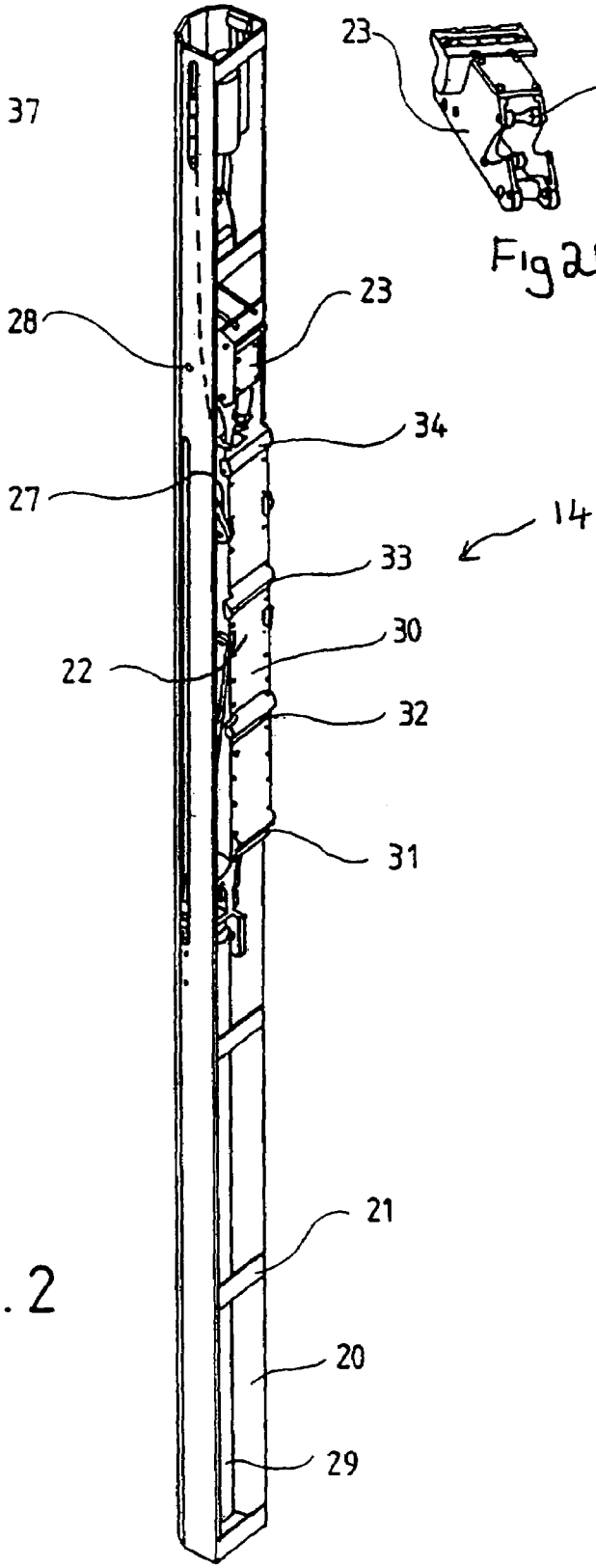
Figure 3:
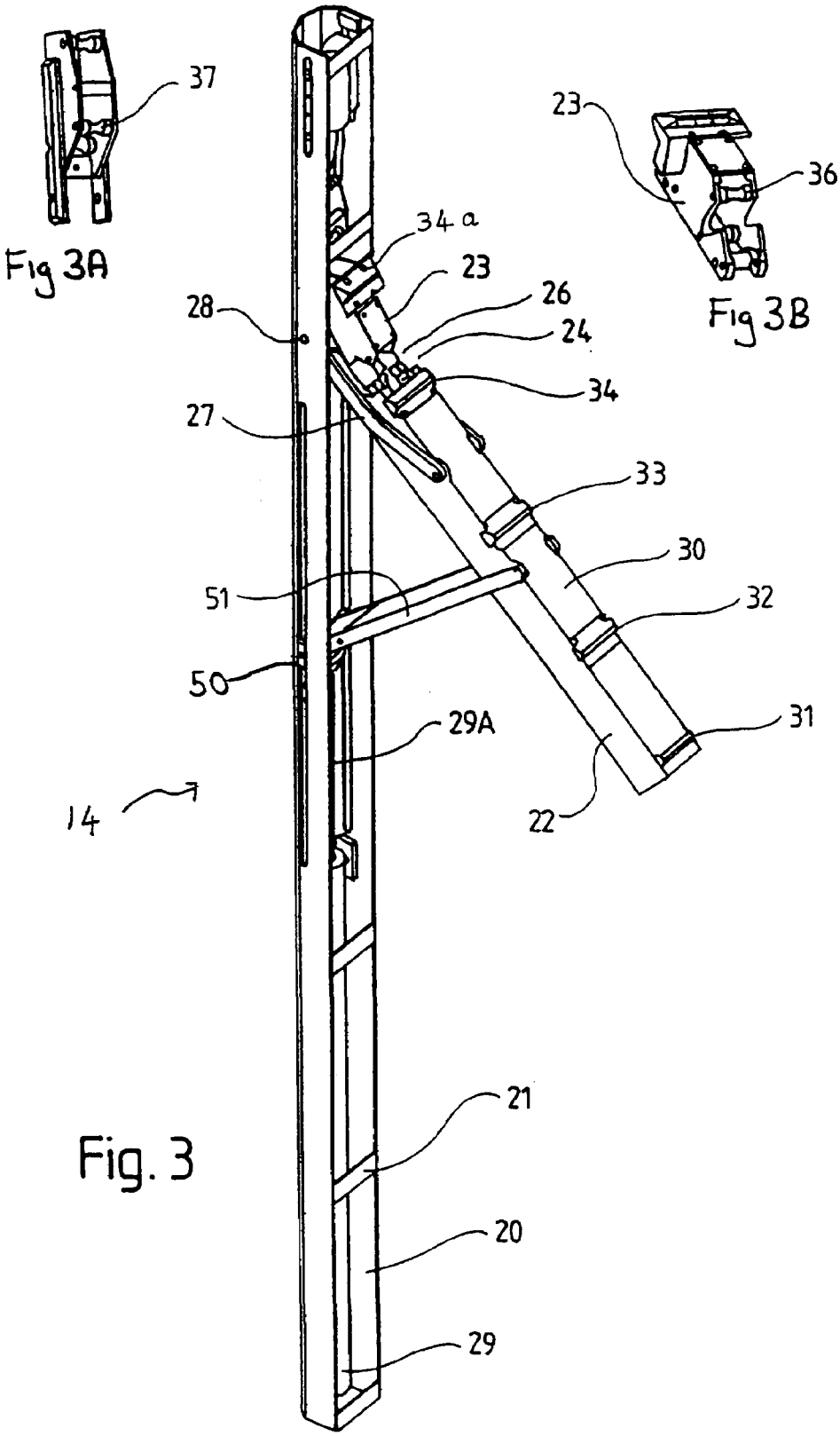

Referring now to FIGS. 2 and 3, there is illustrated in greater detail the assembly 14.

Assembly 14 comprises a prismatic main body 20 which is elongate and hollow throughout its length. Body 20 is half hexagonal and open at the front in cross-section. Body 20 is sized to allow it to be lowered down borehole 11 to a desired position, for instance, adjacent a coal seam.

Body 20 is fully open at the front, except for some structural stiffening members 21. This opening allows an internal arm member 22 to extend from body 20. Arm member 22 in FIG. 2 is positioned entirely within body 20 thereby allowing the assembly 14 to easily move along bore 11.

Arm member 22, as shown in FIG. 2, is formed from two separate members being a first shorter arm member 23, and a second longer arm member 22. Arm members 23, 22 are hingedly coupled together at 24 to form a linked arm member system. The arm members are tubular or channel-shaped to allow a flexible hose drill string to pass therealong.

The pair of linked arm members 22, 23 provide a larger degree of curvature to a flexible hose drill string passing down the borehole, into body 20, along first arm member 23 and along second arm member 22. This provides a minimum friction path and also reduces the possibility of the flexible hose drill string kinking, becoming caught, or being damaged as the flexible hose drill string passes from a vertical direction to a substantially horizontal direction.

Guides in the form of rollers and the like 36 are located within arm members 22, 23 to assist in guiding the flexible hose drill string along the arm members.

Arm member 22 is hingedly coupled to one end of an opposed pair of plate members 27, the plate members being hingedly attached at 28 to body 20, thereby allowing the arm member to move between its extended position and its retracted position.

In a lower part of prismatic body 20 is an actuator 29 which is in the form of a fluid ram having a ram body and a ram rod 29A, the ram rod being able to move into and out of ram body in the usual manner. In FIG. 3, ram rod 29A is attached to a slide block 50. Slide block 50 is mounted for sliding movement within body 20 and can slide between an upper position shown in FIG. 3 and a lower position shown in FIG. 2. Slide block 50 is moved between its upper and lower positions by ram 29. This is better illustrated in the embodiment of FIG. 4.

Hingedly attached to slide block 50 is a link member 51. Link member 51 is formed from two spaced apart link bars which nest around arm member 22 when in the retracted position illustrated in FIG. 2. This allows the assembly to be formed in a compact manner. Link member 51 is pivotally attached to arm member 22 at a position approximately mid-way along arm member 22.

Thus, when the ram is operated to extend ram rod 29A, slide block 50 is pushed to its upper position which in turn causes link member 51 to be pushed out of body 20, which in turn moves arm member 22 to its extended position illustrated in FIG. 3. Retraction of ram rod 29A causes collapse of arm member 22 back into: body 20. The actuator and link member arrangement provides a stronger and more robust system.

Arm member 22 in the embodiment is a hollow steel member of substantially rectangular cross section. On the upper or leading surface 30 is a cutting means which comprises pairs, or an array of spaced nozzles 31-34.

Nozzles 31-34 are attached to a high pressure fluid hose (not shown) and high pressure cutting fluid can pass through the nozzles to cut a slot or cavity in the coal seam.

Nozzles 31-34 are spaced from each other by a distance approximating the working distance of the high pressure fluid passing through the nozzles. In this manner, efficient cutting of a slot in the coal seam occurs as arm member 22 is raised from the inside of main body 20.

Inside arm member 22 are a number of guides in the form of rollers 36. Rollers 36 function to guide the high pressure hose which powers the self-propelled steerable jet nozzle 16 illustrated in FIG. 1. That is, rollers 36 prevent the hose from kinking as the hose passes from the inside of main body 20 to along the inside of arm member 22. Further guides in the form of rollers 37 are positioned inside main body 20 and on a pair of spaced apart plates between which the high pressure hose which powers the self-propelled steerable jet nozzle passes.

In use, assembly 14 is passed down bore 11 until it reaches the desired position (within a coal seam). Water under high pressure is then supplied to nozzles 31-34 and at the same time ram 29 is actuated to begin movement of arm member 22. Initially, the forward portion of arm member 22 (that is, adjacent nozzles 31) will contact the side wall of the bore and these nozzles will begin to cut into the coal seam. High pressure water passing through nozzles 31-34 will also begin to cut into the coal seam as arm member 22 is further raised. The amount of movement of arm member 22 can be controlled by the degree of actuation of ram 29 and thus arm member 22 can be raised to 90° or over, but can also be raised partially, for instance, depending on the relative dip of the coal seam if the coal seam is not horizontal.

Once the arm member 22 has been raised to its desired amount, high pressure water is shut off from nozzles 31-34 and a flexible hose drill string can be lowered down existing borehole 10 and into arm member 22. The end of the drill string is provided with a cutter, such as a fluid cutter, to then cut the passageway into the coal seam.

In a variation, a self-advancing steerable jet nozzle can be pre-positioned within arm member 22 before the assembly is lowered into the borehole. In this variation, the high pressure hose which supplies the self-propelled steerable jet nozzle is guided by rollers 36 and 37 and passes up bore 11 to the high pressure pump and hose winch 18. Thus, the hose forms the drill string to the self-propelled steerable jet nozzle.

Water from the high pressure water pump 61 is supplied via the high pressure hose to the jet nozzle 16 at up to full pressure of 1150 bar at 234 litres per minute, thereby operating the cutting jet or jets and propelling the retrojet or jets. The self-advancing nozzle penetrates the coal seam, the continuous flexible hose drill string (that is, the high pressure hose) is pulled behind it.

The self-propelled nozzle can penetrate into the seam for a distance of up to 200 metres or more with typical drilling times of less than two hours. The nozzle can then be retracted by winding the high pressure hose. Ram 29 can then be actuated to return arm member 22 back into its retracted position as shown in FIG. 2. The assembly 14 can then be pulled up the hole, or alternatively, can be rotated about its longitudinal axis and the arm member extended to cut another passageway into the coal.

The assembly 14 can be attached to the surface by means of a conventional tubular steel drill rods or some other system such as coiled tubing. The tubular steel drill rods or tubing supports the assembly 14 within the borehole. The drill string or tubing provides the conduit to allow high pressure fluid to pass through the drill string or tubing and into cutting nozzles 31-34*a*. Alternatively, a flexible high pressure hose can be used to supply water to these cutters. Rollers 36-37 provide a suitable bend radius for the flexible hose drill string which is connected to the self-propelled drilling nozzle 16, thereby allowing the flexible hose drill string to feed smoothly through the assembly as the nozzle penetrates laterally away from the assembly.

Figure 4:
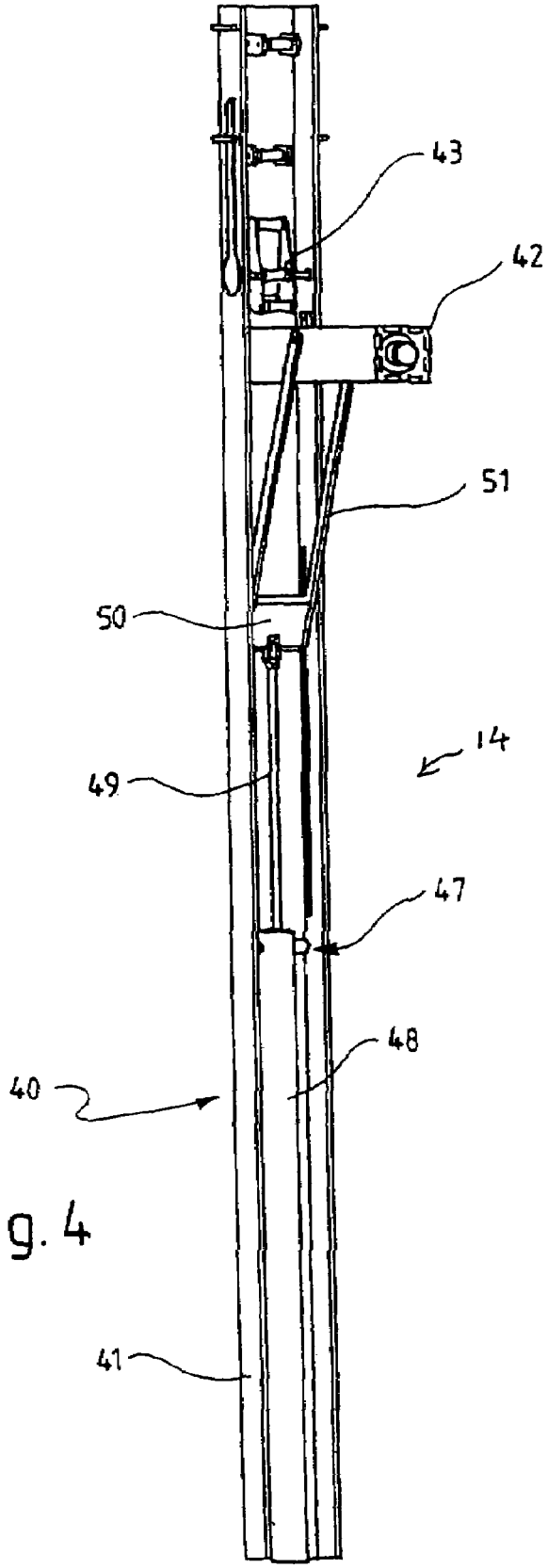
FIG. 4 is a view of an alternative assembly having a single linked arm member and without cutters, and in the extended position.

FIG. 4 illustrates an assembly 40 according to another embodiment. In this embodiment, the assembly does not have any self slotting capability, but does house a self-propelled fluid cutting device in the extendible arm member. The assembly is lowered down a borehole which has an already formed cavity in it. Assembly 40 is similar to that described with reference to FIGS. 2 and 3 in that it has an main elongate body 41 which is substantially hollow throughout its length. In body member 41 is an arm member 42 which can be moved between a retracted position (not shown) and an extended position illustrated in FIG. 4. In the retracted position, arm member 42 is entirely within or essentially within body member 41 to allow the assembly 40 to be lowered into a borehole.

Guides in the form of rollers and the like 46 are located within arm member 42 and a small mostly internal arm member 43 to assist in guiding the flexible hose drill string along main body 40 and along arm member 42 and to minimise kinking of the drill string.

In a lower part of body member 41 is an actuator 47 which is in the form of a fluid ram having a ram body 48 and a ram rod 49, ram rod 49 being able to move into and out of ram body 48 in the usual manner. Ram rod 49 is attached to a slide block 50. Slide block 50 is mounted for sliding movement within body member 41 and can slide between an upper position shown in FIG. 4 and a lower position (not shown). Slide block 50 is moved between its upper and lower positions by operation of actuator 47.

Hingedly attached to slide block 50 is a link member 51. Link member 51 is formed from two spaced apart link bars which can nest around arm member 42 when arm member 42 is in its retracted position. This allows the assembly to be formed in a compact manner. Link member 51 is pivotally attached to arm member 42 at a position approximately mid-way along arm member 42.

Thus, when the ram is operated to extend ram rod 49, slide block 50 is pushed to its upper position which in turn causes link member 51 to be pushed out of main body 41 which in turn moves arm member 42 to its extended position illustrated in FIG. 4. Retraction of ram rod 49 causes collapse of arm member 42 back into main body 41.

Figure 5:
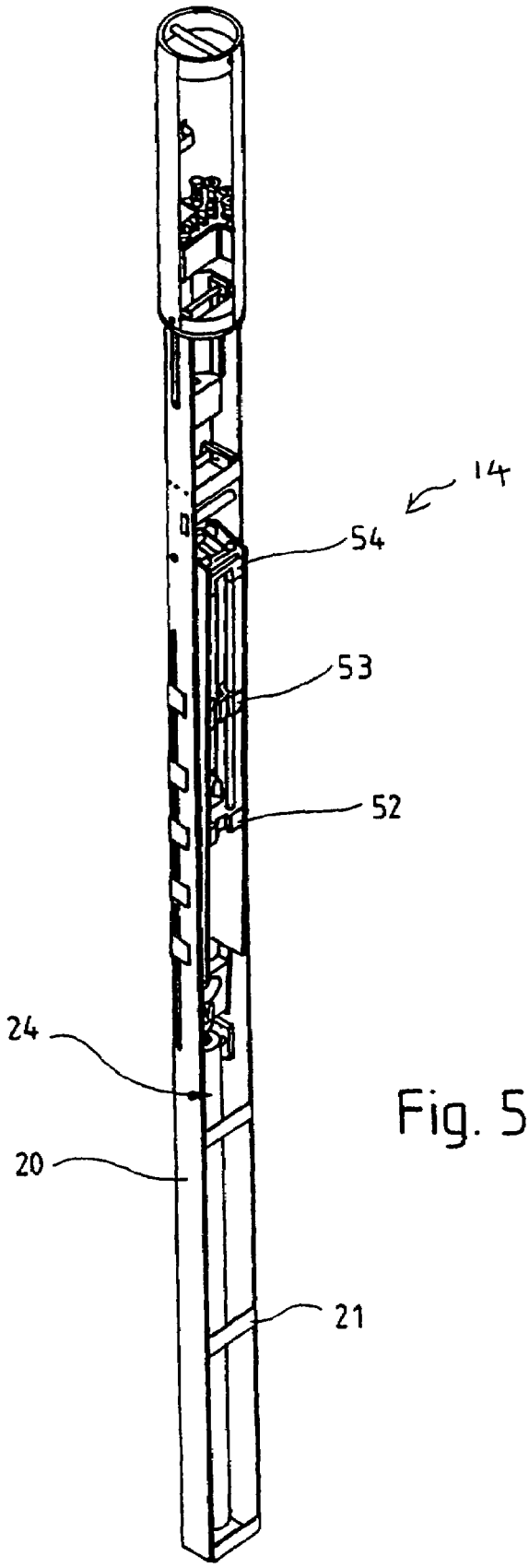
FIG. 5 is a view of another assembly in the retracted position, with fluid cutters, and with no provision for a flexible hose drill string to pass through the arm member. (ie a pure cutter).
Figure 6:
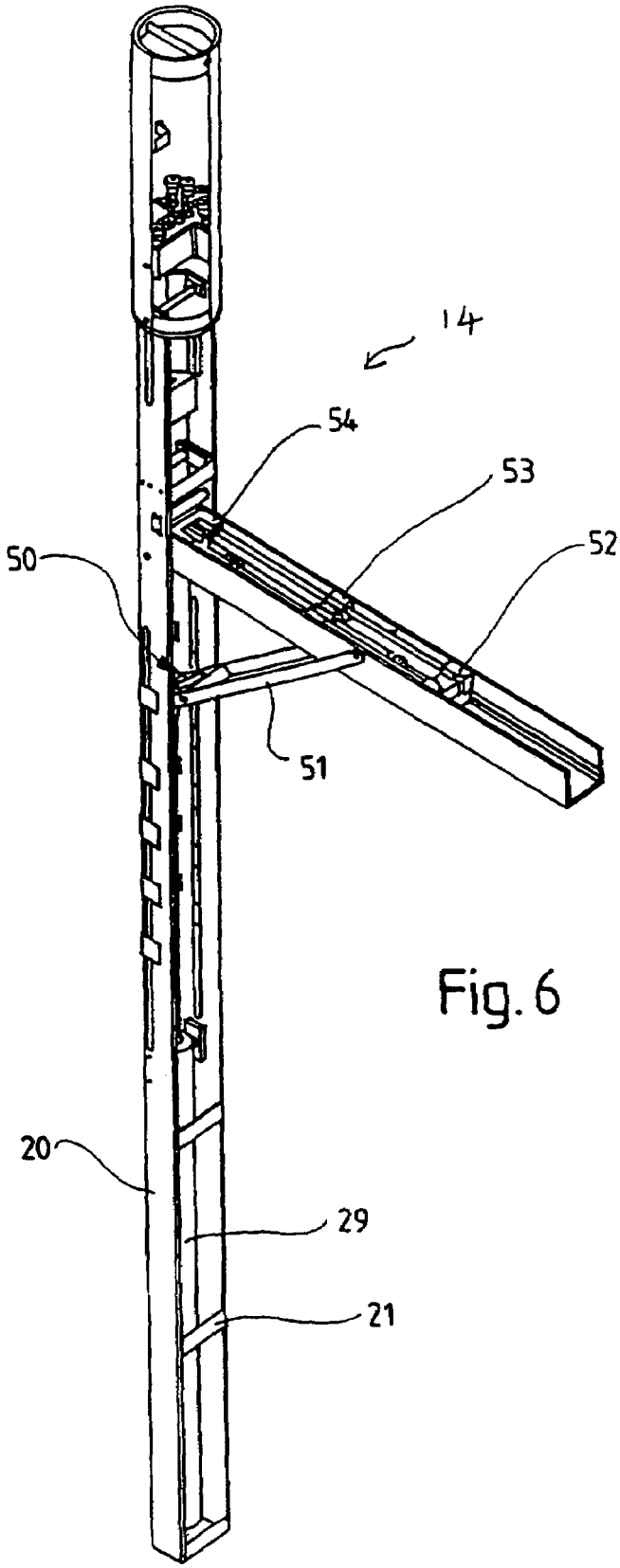
FIG. 6 is a view of the assembly of FIG. 5 in the extended position.

FIGS. 5 and 6 illustrate an assembly similar to the assembly illustrated in FIG. 4 but now including fluid cutters 52-54. These cutters are similar to the cutters and arrangement illustrated and described with reference to FIGS. 2 and 3 except that they are rigidly linked to a tramming hydraulic cylinder (not illustrated). This enables nozzles 52-54 to oscillate during cutting. In this embodiment, the assembly excludes the provision of a drill string passing through the main body and the arm member. This assembly simply creates the required slots and can then be removed from the borehole after which the assembly of FIG. 4 can be inserted to allow drilling.

An air supply to an air lift device in the foot of the assembly may be provided to assist in removal of cuttings from the borehole as lateral penetration of the drilling nozzle occurs, and as the assembly forms the required slot.

In one embodiment of the TRD system, a brief description of operation is as follows—

A borehole which is usually vertical is conventionally drilled from surface (14¼" diameter), intersecting the targeted seams for drainage. A sump of sufficient capacity to take the cuttings from both the reaming/slotting operation and horizontal turnouts, and to house the foot pump once the production phase of the well commences is included. The well is lined with 9⅝" casing. The casing material over the seam intersections is fibreglass. Alternatively, other casing materials such as steel, fibreglass, aluminium or PVC may be used. The casing is cemented into position. A conventional oilfields hole opener is lowered down to the bottom seam intersection and the casing and cement removed. The hole opener is retrieved and a modified marine casing cutter is lowered down the hole and a cavity reamed to a diameter suitable to allow full erection of the assembly such as over the full interval of the seam. Some coal may be left in the roof of the cavity if this improves the stability of the cavity. This procedure is repeated for all seams to be drained.

Once the cavities have been formed the TRD skid is moved into position adjacent to the collar of the well. The assembly is attached to 2⅜" EUE tubing and the flexible hose drill string is threaded through the assembly such that the water jet nozzle is housed in the erectable arm. The control bundle is attached to the assembly and a check made on the functionality of the assembly and its associated instrumentation. The assembly is then lowered down the hole by means of the tubular steel drill rods. The high pressure hose and control bundle are fed down at the appropriate speed. The control bundle is strapped to the drill rods at regular intervals such that its weight is fully supported. Centralisers are added every 10 m to provide a low friction path for the passage of the flexible hose drill string once horizontal drilling commences.

Upon reaching the seam to be drained the assembly is orientated to the correct azimuth by means of the onboard compass and is clamped against the borehole wall and the arm is erected. This brings the water jet nozzle in close proximity to the wall of the cavity. The preferred sequence of horizontal drilling is from bottom to top of the existing borehole. Before commencing drilling, the high pressure pump is brought up to full pressure (e.g. 1150 bar at 234 litres per minute). The high pressure spinning jets emanating from the front of the nozzle commence to create a horizontal borehole. Forward thrust is generated from the rearward facing high pressure jets. This thrust causes the drilling assembly to move forward into the cavity wall as high pressure hose is fed from the drum on the surface.

In this manner, horizontal boreholes of up to 200 metres in length are produced. Upon full extension, the pump pressure is dropped to around 700 bar and the drilling assembly retracted back into the erectable arm by means of the powered drum mounted on the surface skid. The erectable arm is collapsed, the assembly unclamped and the assembly rotated to a new azimuth direction. The assembly arm is again clamped and the assembly arm is erected and another horizontal hole is drilled. This process is repeated until the required number of directional lateral boreholes are formed at each level in each horizon. The assembly is then pulled out of the hole. The cuttings formed during the formation of the lateral boreholes are then cleaned from the sump by means of a reverse circulation system.

It can be seen that the assembly, and the combination of the assembly with a self-advancing steerable drilling assembly within arm member 22 provides a number of distinct advantages over conventional devices. For instance, the assembly contains an extensive range of instrumentation to monitor the borehole conditions and the operation of the lateral borehole formation in the self-advancing drilling system. This leads to effective formation of lateral boreholes to a typical distance of 200 metres and in drilling times of less than two hours. The assembly allows rapid repositioning to allow multiple lateral borehole creation. This array of multiple lateral boreholes at one or more horizons is particularly suitable for the extraction of fluids such as water and methane through a single existing borehole.

The assembly can position the resultant cutting device more accurately than conventional devices.

It should be appreciated that various other changes and modifications may be made to the embodiment described without departing from the spirit and scope of the invention.

The invention claimed is:

1. An erectable arm assembly for use in a vertical borehole, the erectable arm assembly comprising a main body and an arm member, the arm member movable between a collapsed position in which the assembly can be removed from the vertical borehole and an erected position, the arm assembly being configured to house a fluid drilling assembly comprising a self propelled fluid cuffing device directing a propelling force outwardly from the device and a flexible, axially unsupported hose drill string pulled by the fluid cuffing device such that during erection the arm member can contain at least part of the fluid drilling assembly, and when in the erected position the arm member is of sufficient length to be able to guide the fluid cuffing device towards the borehole wall, pulling the flexible hose drill string behind it.

2. The assembly of claim 1, wherein the fluid cutting device can be retracted into the arm member.

3. The assembly of claim 2, further comprising a sensor configured to detect when the fluid cutting device has been retracted into the arm member.

4. The assembly of claim 3, wherein the sensor comprises an electro magnetic sensor which is configured to detect the presence of the fluid cuffing device.

5. The assembly of claim 3, wherein the sensor comprises an electric sensor which is configured to detect the presence of the fluid cuffing device.

6. The assembly of claim 1, further comprising a sensor configured to detect an angle of erection of the arm member relative to the main body.

7. The assembly of claim 6, wherein the sensor comprises a tilt transducer.

8. The assembly of claim 6, further comprising:

an hydraulic or pneumatic ram coupled to the arm member to move the arm member between the collapsed position and erected position, the ram being attached at one end to the main body and at the other end to the arm member; and a sensor positioned to determine an extension of the ram.

9. The assembly of claim 1, further comprising guides positioned to guide the flexible hose drill string through the main body and the arm member.

10. The assembly of claim 1, further comprising a sensor positioned to detect the position and/or direction of travel of the flexible hose drill string.

11. The assembly of claim 1, further comprising a compass positioned to detect the azimuth of the arm member.

12. The assembly of claim 1, wherein the arm member is formed from at least two arm members coupled together to provide a larger degree of curvature for a drill string.

13. The assembly of claim 1, wherein the arm member has at least one fluid cutting nozzle thereon to cut a slot in the bore wall as the arm is erected, the at least one nozzle being positioned to be connected to a supply of high pressure fluid.

14. The assembly of claim 1, wherein the main body is elongate and the arm member is pivotally attached to the main body and is movable about a pivot axis between the collapsed and the erected position.

15. The assembly of claim 14, wherein the arm member in the collapsed position is housed generally within the main body.

16. An erectable arm assembly for use in a vertical borehole, the erectable arm assembly comprising:

a main body;

an arm member that is movable between a collapsed position in which the assembly can be removed from the vertical borehole, and an erected position; and a fluid drilling assembly carried by the arm member, the fluid drilling assembly being deployable from and retractable into the arm member, wherein during erection of the arm member the arm member contains at least part of the fluid drilling assembly, the fluid drilling assembly including:

a self propelled fluid cutting device directing a propelling force outwardly from the device; and an axially unsupported flexible hose drill string pulled by the fluid cutting device, the flexible hose drill string being axially unsupported by the assembly in a region between the fluid cutting device and the arm member when the fluid cutting device is deployed from the arm member.

17. A method for forming a lateral borehole, comprising:

lowering an erectable arm assembly into a generally vertical borehole;

erecting an arm member of the assembly relative to a main body of the assembly;

initiating formation of a generally lateral bore by directing a fluid jet from a self advancing fluid cutting device while the fluid cutting device is carried by the arm member, wherein the arm member carries at least a portion of the fluid cutting device when erecting the arm member;

advancing the fluid cutting device into the lateral bore under fluid power directed from the fluid cutting device, while pulling a flexible hose drill string behind the fluid cutting device and while supplying fluid to the fluid cutting device via the drill string;

supporting part of the fluid cutting device with the arm member as the fluid cutting device advances from the arm member into the lateral bore; and continuing to advance the fluid cutting device under its own power away from the arm member so that a portion of the flexible hose drill string between the fluid cutting device and the arm member is axially unsupported.

* * * * *

UNITED STATES PATENT AND TRADEMARK OFFICE

CERTIFICATE OF CORRECTION

PATENT NO. : 7,370,710 B2
APPLICATION NO. : 10/957104
DATED : May 13, 2008
INVENTOR(S) : Trueman et al.

It is certified that error appears in the above-identified patent and that said Letters Patent is hereby corrected as shown below:

Title Page;

On page 2, in field (56), under "U.S. Patent Documents", in column 1, line 12, delete "Dickison" and insert -- Dickinson --, therefor.

In column 4, line 13, delete "-a" and insert -- a --, therefor.

In column 5, line 35, delete "nay" and insert -- may --, therefor.

In column 6, line 5, delete "electromagnetic" and insert -- electro-magnetic --, therefor.

In column 6, line 60, delete "(ie" and insert -- (i.e., --, therefor.

In column 7, line 64, after "on" delete "a".

In column 8, line 45, delete "electro magnetic" and insert -- electro-magnetic --, therefor.

In column 10, line 48, after "into" delete ":".

In column 12, line 1, delete "an" and insert -- a --, therefor.

In column 14, line 11, in Claim 1, delete "cuffing" and insert -- cutting --, therefor.

In column 14, line 14, in Claim 1, delete "cuffing" and insert -- cutting --, therefor.

In column 14, line 17, in Claim 1, delete "cuffing" and insert -- cutting --, therefor.

UNITED STATES PATENT AND TRADEMARK OFFICE

CERTIFICATE OF CORRECTION

PATENT NO. : 7,370,710 B2
APPLICATION NO. : 10/957104
DATED : May 13, 2008
INVENTOR(S) : Trueman et al.

It is certified that error appears in the above-identified patent and that said Letters Patent is hereby corrected as shown below:

In column 14, line 25, in Claim 4, delete “electro magnetic” and insert -- electro-magnetic --, therefor.

In column 14, line 26, in Claim 4, delete “cuffing” and insert -- cutting --, therefor.

In column 14, line 29, in Claim 5, delete “cuffing” and insert -- cutting --, therefor.

Signed and Sealed this

Twenty-sixth Day of August, 2008

JON W. DUDAS
*Director of the United States Patent and Trademark Office*